United States Patent [19]

Foster, Jr.

[11] 4,219,391

[45] Aug. 26, 1980

[54] ELECTROLYTIC PRODUCTION OF METAL

[75] Inventor: Perry A. Foster, Jr., New Kensington, Pa.

[73] Assignee: Aluminum Company of America, Pittsburgh, Pa.

[21] Appl. No.: 717,700

[22] Filed: Aug. 25, 1976

Related U.S. Application Data

[63] Continuation-in-part of Ser. No. 645,533, Dec. 31, 1975, abandoned.

[51] Int. Cl.[2] ..... C25C 3/00; C25C 3/06

[52] U.S. Cl. ..... 204/67; 204/64 R; 204/243 R

[58] Field of Search ..... 204/67, 243 R, 64–70

[56] References Cited

U.S. PATENT DOCUMENTS

| | | | |
|---|---|---|---|
| 400,664 | 4/1889 | Hall | 204/67 |
| 2,231,030 | 2/1941 | Scofield et al. | 204/67 |
| 3,400,061 | 9/1968 | Lewis et al. | 204/67 |

*Primary Examiner*—Howard S. Williams
*Attorney, Agent, or Firm*—Daniel A. Sullivan, Jr.

[57] ABSTRACT

A method for the electrolytic production of metal, including electrolyzing, between anodic and cathodic surface areas, a compound of the metal dissolved in a molten solvent, the electrolyzing being performed at a temperature such that the metal is formed in the molten state, the metal collecting in a molten metal pad, wherein the improvement includes the provision of cathodic surface area in the form of an array of elements protruding out of the pad into the solvent toward the anodic surface area for establishing a series of locations at which the anode-cathode distance is up to $1\frac{1}{4}$ inches.

A method for the electrolytic production of metal, including electrolyzing, between anodic and cathodic surface areas, a compound of the metal dissolved in a molten solvent, the electrolyzing being performed at a temperature such that the metal is formed in the molten state, wherein the improvement includes the provision of cathodic surface area formed from at least one hollow body in the solvent, the hollow body containing molten material.

A method for the electrolytic production of metal, including electrolyzing, between anodic and cathodic surface areas, a compound of the metal dissolved in a molten solvent, the electrolyzing being performed at a temperature such that the metal is formed in the molten state, wherein the improvement includes the provision of cathodic surface area in the form of a grate inserted in the solvent.

10 Claims, 9 Drawing Figures

ELECTROLYTIC PRODUCTION OF METAL

CROSS REFERENCE TO RELATED APPLICATIONS

This is a continuation-in-part of U.S. application Ser. No. 645,533, filed Dec. 31, 1975 now abandoned.

FIELD OF THE INVENTION

The present invention relates to the production of metal by electrolysis of a compound of the metal dissolved in a molten solvent, and, more particularly, to methods of producing aluminum by electrolysis of an aluminum compound dissolved in a molten solvent.

SUMMARY OF THE INVENTION

It is an object of the present invention to provide methods for the electrolytic production of metal, which methods utilize improved situations of cathodic surface area with respect to molten metal pad, molten solvent and anode.

This as well as other objects which will become apparent in the discussion that follows are achieved, according to the present invention, by providing:

(1) A method for the electrolytic production of metal, including electrolyzing, between anodic and cathodic surface areas, a compound of the metal dissolved in a molten solvent, the electrolyzing being performed at a temperature such that the metal is formed in the molten state, the metal collecting in a molten metal pad, wherein the improvement includes the provision of cathodic surface area in the form of an array of elements protruding out of the pad into the solvent toward the anodic surface area for establishing a series of locations at which the anode-cathode distance is up to $1\frac{1}{4}$ inches.

(2) A method for the electrolytic production of metal, including electrolyzing, between anodic and cathodic surface areas, a compound of the metal dissolved in a molten solvent, the electrolyzing being performed at a temperature such that the metal is formed in the molten state, wherein the improvement includes the provision of cathodic surface area formed from at least one hollow body in the solvent, the hollow body containing molten material.

(3) A method for the electrolytic production of metal, including electrolyzing, between anodic and cathodic surface areas, a compound of the metal dissolved in a molten solvent, the electrolyzing being performed at a temperature such that the metal is formed in the molten state, wherein the improvement includes the provision of cathodic surface area in the form of a grate inserted in the solvent.

DETAILED DESCRIPTION

Figure 1:
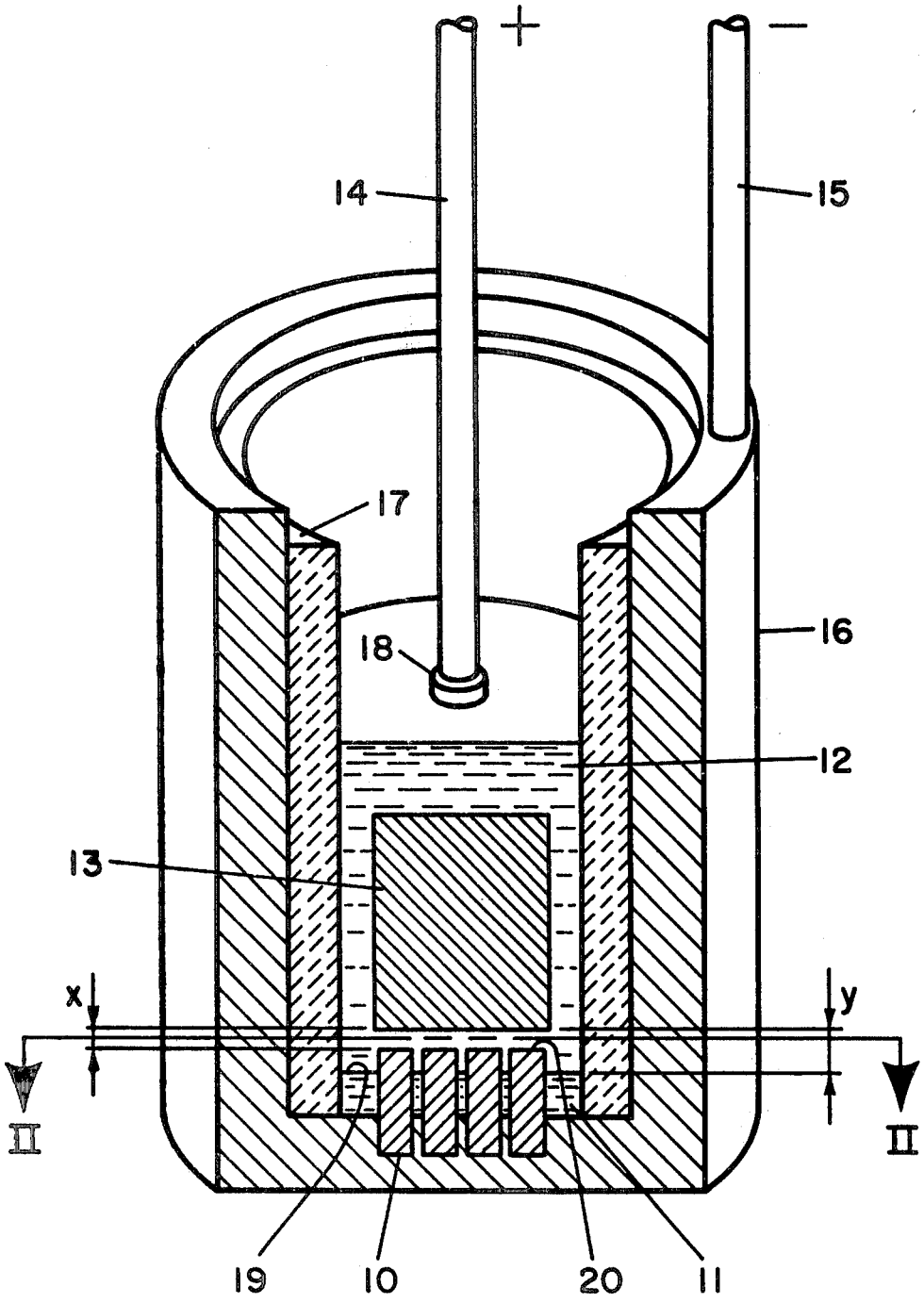
FIG. 1 is an elevational cross section of a cell utilizing one embodiment of methods according to the present invention.
Figure 2:
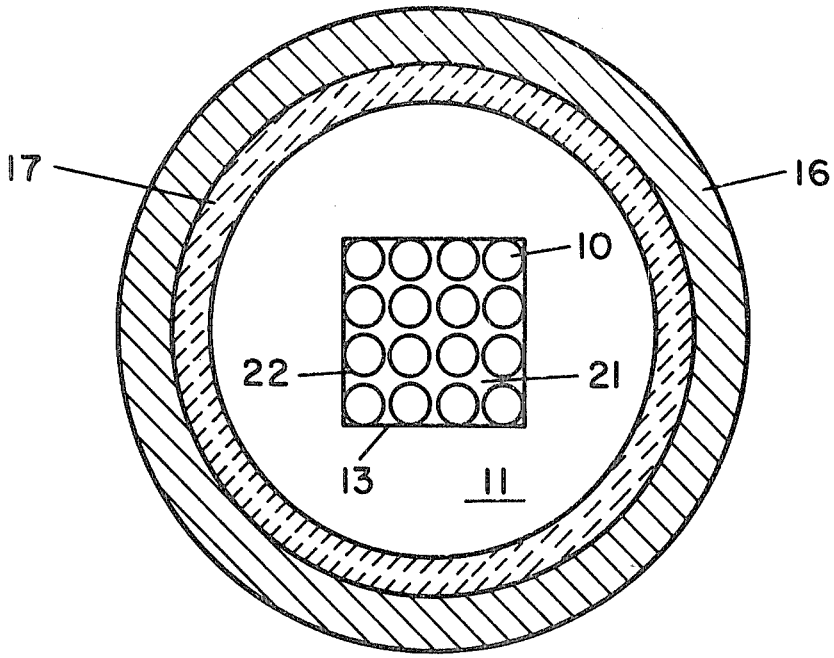
FIG. 2 is a cross sectional view taken on the line II—II of FIG. 1.

Referring firstly to FIGS. 1 and 2, that set of figures illustrates one embodiment of the methods of the present invention. Of special significance in this embodiment is the provision of cathodic surface area in the form of an array of elements, in this case cylindrical studs 10, protruding out of the molten metal pad 11 into the solvent 12 toward the anode 13 for establishing a series of locations at which the anode-cathode distance x is up to $1\frac{1}{4}$ inches, i.e. less than or equal to $1\frac{1}{4}$ inches. Preferably, this distance x is less than or equal to one inch; more preferably, less than or equal to $\frac{3}{4}$ inch. With decreasing distance x, the voltage drop experienced in the solvent becomes advantageously less. Metal pad 11 is not drawn down so low, for instance in tapping, as to allow solvent 12 to come into contact with the floor of the cell.

The perimeter of the anode 13 has been projected onto the plane of FIG. 2 for the purpose of showing how the anode is dimensioned and situated to sit over the array of studs 10.

Certain portions of what is shown in FIGS. 1 and 2 are certainly capable of being altered, within the broader concept of the present invention, by those skilled in the art, these portions including a lead 14 to the anode from the current source, a cathodic lead 15 from the current source to a conductive crucible 16 contacted by the studs 10, an insulative liner 17, and an insulative sleeve 18. Sleeve 18 extends down into contact with anode 13 and serves to prevent a short circuiting of the electrical current between lead 14 and crucible 16, for instance by way of a carbon particle scum on the surface of solvent 12. Advantageous to a subsidiary aspect of this embodiment, for instance for protecting against re-oxidation of the produced metal, is the fact that the metal pad is more cathodic than the anode, this being due to the fact that the metal pad 11 lies in contact with the same conductive crucible 16 which supplies the cathodic current to the studs 10.

One of the important features of the general method forming the basis of FIGS. 1 and 2 is that the elements form locations of minimized anode-cathode distance x, so that the electrolytic action takes place primarily at these locations. This means minimized voltage drop experienced by the electrolytic current on its passage through the solvent electrolyte 12. It also means that magnetic turbulence in the metal pad 11 no longer can hinder achievement of minimized anode-cathode distances. The effective region of electrolytic action has been removed from the region of the top surface 19 of the metal pad and brought to the region of the ends 20 of an array of elements protruding up out of the pad.

It is advantageous if the elements are wet by the metal being produced. This prevents the buildup of large globules of metal on the ends 20 of the elements nearest the anode, thus reducing the danger of short circuiting, and it provides a protective coating of the produced metal on the elements which can be advantageous in increasing the service life of the elements. The distance x may be made as small as possible, but it must not be made so small that the electrical current begins to short circuit from the anode, through the molten metal on the ends 20, and into the elements, without passing through the solvent. The more easily the elements are wet by the metal being produced the more distance x can be minimized, because then there is an absence of large globules of metal on the ends 20. This advantage of wetting holds even in the embodiment of, for instance, FIGS. 5 and 6, because then the molten metal in the centers of the tubes does not bulge upwards, which would be the case if the material of the tubes were not wet by the molten metal. A typical minimum distance x has been found to be $\frac{1}{4}$ of an inch, although, with improved wetting, it is entirely conceivable that x could be reduced to $\frac{1}{8}$ of an inch or even 1/16 of an inch.

The fact that the elements are provided in the form of an array is advantageous for assuring replenishment of the dissolved compound of the metal being produced at the sites of minimized anode-cathode distance where electrolysis is primarily being carried out. In contrast, if instead of an array of elements, there were provided only an essentially planar, although perhaps tilted for draining, cathode, then there would be no pools 21 of solvent available for replenishment of much of the area of electrolytic activity with new dissolved compound. For the purpose of assuring that the pools 21 of solvent be adequate reservoirs of the compound being electrolyzed, it is advantageous that the distance y separating the metal pad from the anode be at least $1\frac{1}{2}$ inches. Preferably, distance y should be at least 2 inches. More preferably, it should be $2\frac{1}{2}$ inches.

In the broader concept of the embodiment of FIGS. 1 and 2, there is no necessity that there by any particular order in the array of the elements. For instance, the elements can be set in the cell bottom at completely random points. However, it will be appreciated that a more efficient utilization of the electrolysis zone will be achieved if there is regularity in the array. The elements are shown in FIG. 2 as arranged at the corners of a regular tessellation of mutually congruent squares. Another possibility would be to arrange the elements at the corners of a regular tessellation of mutually congruent equilateral triangles. The geometric terminology here is based on MATHEMATICAL MODELS by H. M. Cundy et al., second edition, Oxford University Press (1961), pages 59 and 60.

Also in the broader concept of the invention, the circular outline 22 of the elements shown in FIG. 2 may be departed from. For instance, for the tessellation of squares, it may be advantageous to provide the elements with a square outline, and, for the tessellation of equilateral triangles, the choice would be an equilateral triangular outline. While at least a portion of the elements must be solid, the outline may even be, for instance, that of an annulus, like in FIGS. 6 and 8.

A tessellation of rectangles is another possibility for the locating of the elements, and the elements themselves can have a rectangular outline. See FIG. 9.

Figure 4:
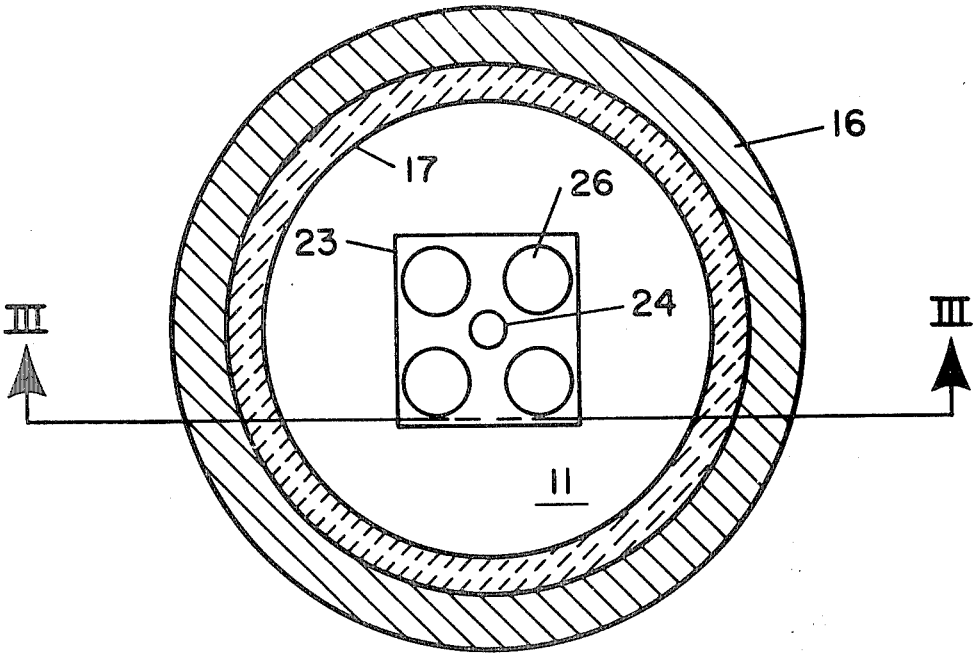
FIGS. 4, 6 and 8 are cross sectional views taken on the lines IV—IV, VI—VI and VIII—VIII of FIGS. 3, 5 and 7, respectively.
Figure 3:
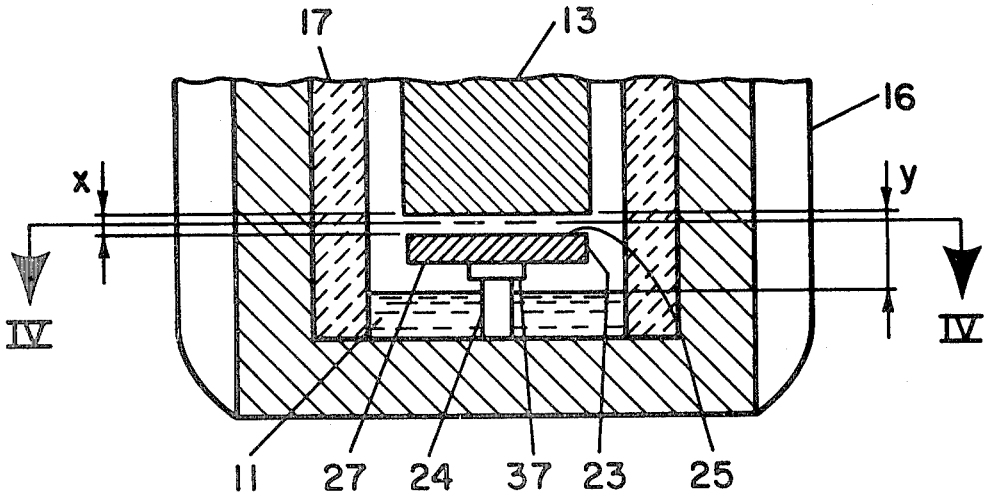
FIGS. 3, 5 and 7 are elevational cross sections, with portions broken away and with the electrolyte removed, of other embodiments of the methods of the present invention.

Referring now to FIGS. 3 and 4, another embodiment of the methods of the present invention is illustrated. FIG. 3 is related to FIG. 4 in the manner shown by the section line III—III of FIG. 4. In this embodiment, of special significance is the fact that cathodic surface area has been provided in the form of a grate 23 inserted in the solvent. Not essential to the broader concept underlying this embodiment is the particular manner in which the cathodic current is transferred between the grate and the source of current, it being in this case by way of a post 24 centrally supporting the grate and secured in the bottom of the crucible 16. Here, it is to be noted that the molten metal in front of the post 24 in FIG. 3 has been rolled back for the purpose of showing that post 24 extends down to the bottom of the crucible. Also not essential to the broader concept of the invention is the remaining structure already described with respect to FIGS. 1 and 2. According to a preferred embodiment, however, the single, central post is used, because the grate is then free to undergo thermal expansions without affecting the connection of the post to the bottom of the cell. Also preferably, the grate has a face 25 turned toward the anode 13, as shown.

As in the case of the embodiment of FIGS. 1 and 2, this embodiment utilizing a grate provides the possibility of reduced anode-cathode distance x, without there being worry about magnetically caused turbulence in the metal pad 11 below.

In this embodiment also, there is the advantage that replenishment of the locations primarily active in the electrolysis with the compound being electrolyzed is possible from the pools of electrolyte lying in the holes 26 of the grate and, through the holes, from the electrolyte lying on the side of the grate opposite to that facing the anode. To promote this replenishment, it is advantageous, when a metal pad is present, that distance y be at least $1\frac{1}{2}$ inches plus the thickness of the grate, with the $1\frac{1}{2}$ inch figure being preferably 2 inches, more preferably $2\frac{1}{2}$ inches. Thus, operation of the cell should not allow the metal pad to reach the face 27 of the grate opposite that facing the anode, because then there is no communication between the solvent in the holes and the rest of the solvent.

The metal formed by the electrolysis is deposited first primarily on the surfaces of the grate which lie closest to the anode, i.e. on face 25 in the illustrated embodiment. This aluminum builds up somewhat and then runs off, through the holes 26 in the illustrated embodiment, to the pad 11 of molten metal lying below. This runoff is facilitated when the material of the grate is wet by the molten metal. It has been found that, in any particular case of temperature of cell operation, metal, solvent, etc., the holes 26 of the grate should preferably be larger than some minimum size, in order to facilitate draining away of the molten metal produced and the replenishment of exhausted solvent at the locations of minimized anode-cathode distance where electrolysis is the most active. For instance, in the embodiment shown, for aluminum metal, using alumina as the compound, holes of $\frac{3}{4}$ inch inner diameter were found to give smooth operation, while holes of $\frac{1}{2}$ inch diameter gave evidence of getting plugged-up during operation.

There are a number of possibilities for providing the grate of this embodiment. For instance, it can be formed completely from one material, as was the case in Example II below. Alternatively, it is envisioned that it should be possible to coat a steel grate with refractory hard metal to accomplish essentially the same object. Additionally, the grate can be of the type characterized by holes extending to the edge, so that the holes do not have closed outlines. The hole outlines can be square or rectangular, for example, rather than round.

The holes in the grate can be arranged on the corners of a regular tessellation. See the discussion above with respect to FIGS. 1 and 2. Thus, it will be understood that, while four holes are shown in the embodiment of FIGS. 3 and 4, a much larger grate with many more holes would preferably be used for an industrial size cell.

Figure 6:
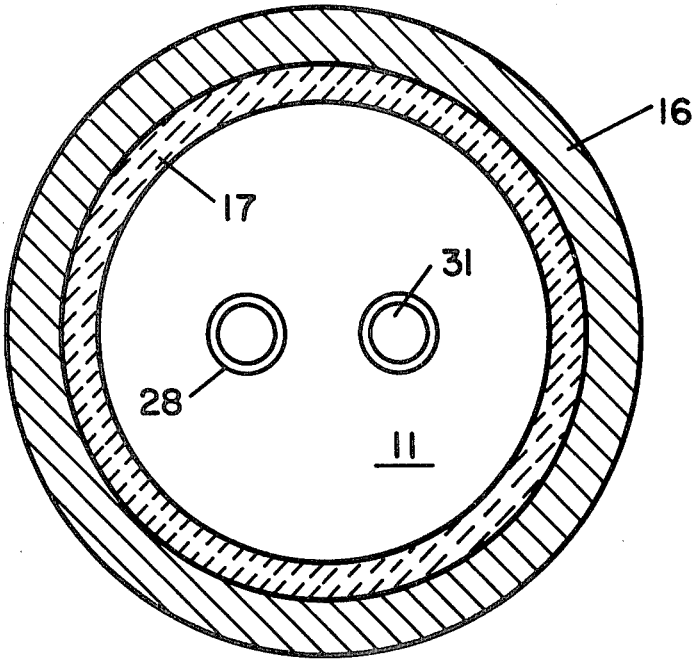
Figure 5:
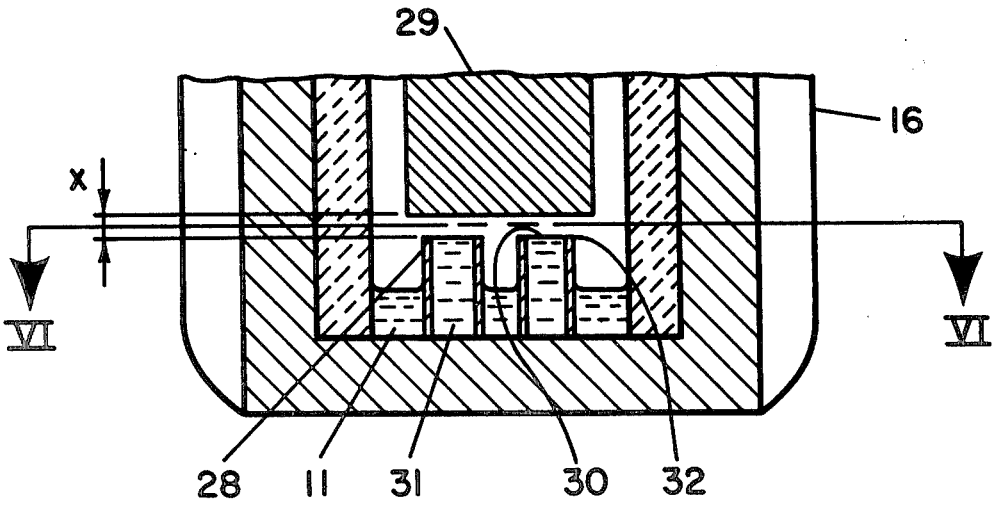

Referring now to FIGS. 5 and 6, there is illustrated another embodiment of the methods of the present invention. Of significance to the broader concept underlying this embodiment is the provision of cathodic surface area formed from at least one hollow body in the solvent, the hollow body containing molten material. In the particular embodiment illustrated, tubes 28 are secured in the bottom of crucible 16 and protrude out of the molten metal pad 11. They end just short of reaching the anode 29. The tube ends 30 closest the anode are open, and the tubes are filled with molten metal 31. Since the molten metal is in contact with the electrically conductive material of the crucible 16 below, there results locations of minimized anode-cathode distance x, wherein the cathodic surface area is provided at least by the molten metal within the tubes. If the tubes themselves are conductive, their rims 32 at the ends near the anode increase the total cathodic surface. According to the broader aspect of these tubes, there is no restriction on their cross sectional shape. It may just as well be square, rather than the circular cross section shown. Also, in the broader aspect, there is no restriction on the length to diameter ratio of the tubes; they may as well be wide, squat tubes of ratio less than one as tall, thin tubes of ratio greater than one. In the case where the tubes are of a material wet by the molten metal, the cathodic surface is essentially just molten metal. Since the molten metal near the anode is of limited expanse, being constrained by the sides of the tube, large undulations of the molten metal near the anode caused by magnetic effects are avoided, so that substantially reduced anode-cathode distances x are possible in this illustrated embodiment also.

The broader concept underlying this embodiment of the invention, i.e. the utilization of a hollow body filled with molten material, is quite advantageous, because preferred materials of construction for any of the embodiments described herein tend to be expensive. By using a hollow body containing molten material, it is possible to save considerably on expensive materials of construction while nevertheless achieving the desired amounts of cathodic surface areas needed for any given cell. In the broadest concept, it is not even necessary that the hollow body be open at the end closest the anode; it can simply be a shell whose interior has been filled with the molten metal or with the solvent electrolyte. However, when the end closest the anode is not open, then the hollow body has to be made of electrically conductive material.

When the hollow body is open at the end closest the anode, then it does not really matter whether the hollow body is made of an electrically conductive material or not. For instance, it is possible to fill the nonconductive body with aluminum metal at the start of the electrolysis, the aluminum metal forming the conductive path through which the electrical current passes for example upwards from underlying carbonaceous material to the electrolytically active locations.

In the case where the open-ended hollow body is made of electrically conductive material, one has the option of either filling the hollow body with molten metal at the beginning of electrolysis or else letting the hollow body fill first with electrolyte and then relying on molten metal produced up at the inner rim of the hollow body to fall and displace the electrolyte out of the hollow body so that it eventually becomes filled with molten metal. The case where the hollow body is itself made of electrically conductive material has the advantage that it is rather insensitive to the possibility that undissolved compound of the metal being produced settle in its interior to form an electrically nonconducting barrier to the flow of electrical current from, for example, underlying carbonaceous material up through the interior of the hollow body. The conductive matter of the hollow body itself can care for the passage of electrical current from the underlying material right into the hollow body contacting it and then up through the walls of the hollow body or its interior, around the barrier, to the locations of primary electrolytic activity.

Figure 8:
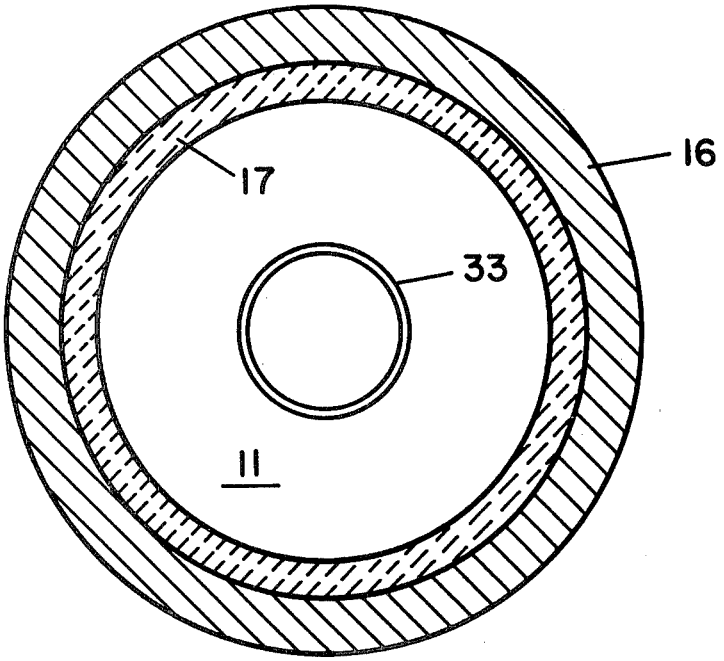
Figure 7:
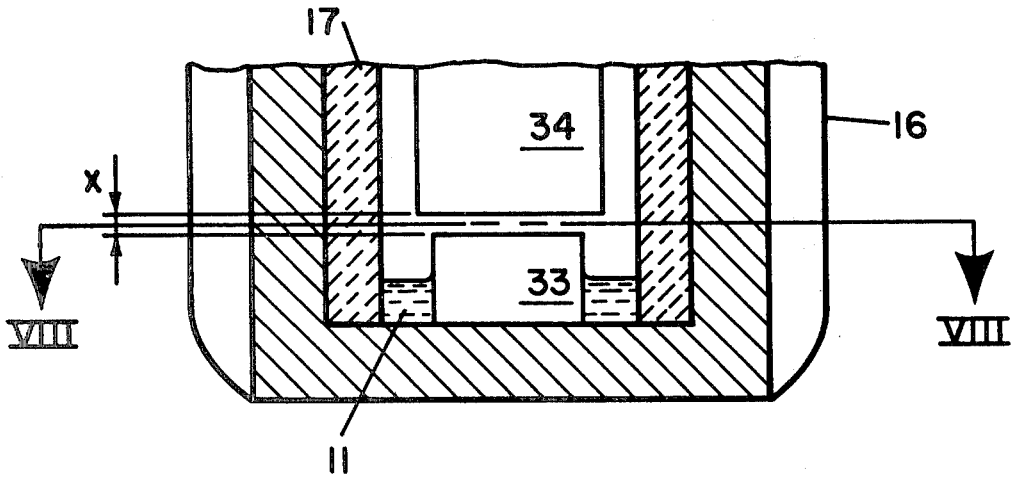

FIGS. 7 and 8 illustrate the use of a single, molten-metal-filled pipe 33, of diameter substantially equalling that of the anode 34, secured in the floor of crucible 16 and protruding out of a metal pad 11 into close proximity to the undersurface of the anode.

Figure 9:
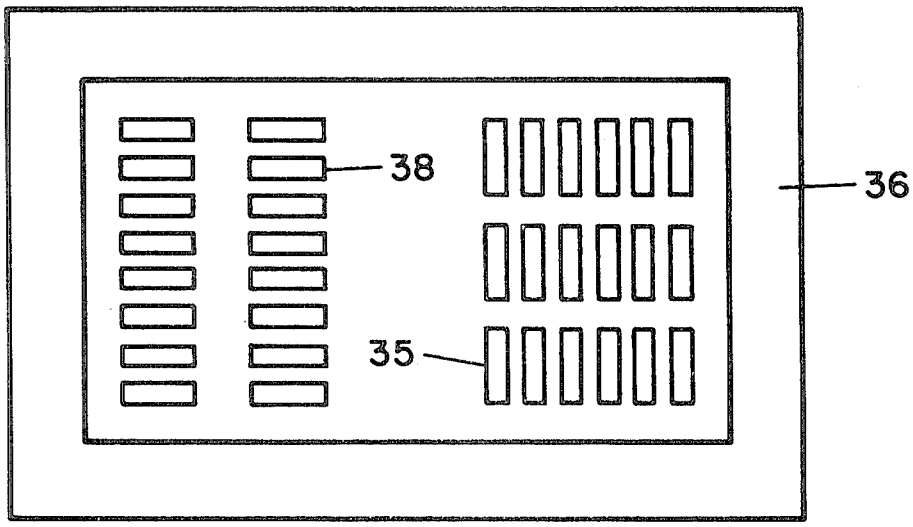
FIG. 9 is a plan view of the lower portion of a cell utilizing one embodiment of the methods of the present invention.

FIG. 9 shows an embodiment of the present invention resembling that of FIGS. 1 and 2, except that studs 35 of rectangular cross section have been used, and the refractory cell walls 36 are in the usual rectangular outline of industrial cells.

Concerning materials for constructing the special cathodic surfaces in the methods of the present invention, essentially it is a matter of balancing the cost of the materials against how long they can stand up under extended periods of time in the presence of the molten metal and the molten solvent for its compound being electrolyzed. The temperatures can be high. Typically, in the case of aluminum being produced by the electrolysis of alumina, which is a preferred mode of the present invention, electrolysis is carried out in the neighborhood of 900° C.

Given that the material is resistant to the environment in that it does not fall apart or dissolve under operational conditions, it is further advantageous that it be wet by the metal being produced. Additionally, the higher the electrical conductivity of the material, the better is the material suited for use in the present invention. Another favorable aspect of the material would be that its dimensions remain constant over long periods of use.

In general, sintered composites of refractory hard metals have given the best service in the experiments underlying this invention. A basic book describing the refractory hard metals is REFRACTORY HARD METALS by P. Schwarzkopf et al., The MacMillan Company, 1953. Refractory hard metals are in general defined to mean substances in the group carbides, borides, silicides and nitrides of the transition metals in the groups IVa, Va, and VIa of the Periodic Table. This designation of groups is on the basis of the Periodic Table in FIGS. 2–18 of THE NATURE OF THE CHEMICAL BOND by Linus Pauling, Third Edition, Cornell University Press (1960). These carbides, borides, silicides and nitrides may be combined with compounds such as aluminum boride, nitride and carbide, and compounds of the rare earth metals. Some include silicon carbide in this grouping. A preference has been stated for the borides, nitrides, and carbides of titanium and zirconium.

It has, however, been found through experience that, for instance, not every $TiB_2$ composite supplied by manufacturers of those composites stands up under the service conditions present in a cell for the electrolytic production of aluminum. Two composites may seem the same and yet one will survive and the other will fail. To cope with this situation, a bench scale cell was designed and is described in Example I below. In this cell, a proposed material supplied by a potential supplier is used for the electrolytic production of aluminum over a period of 100 hours. At the end of this time, the cell is drained and the candidate material checked for signs of disintegration or dissolution. If the material has survived, then it is judged to be at least a potential candidate for commercial use where service life of up to three and four years should be expected.

Examples of materials which would be suitable for practice of the methods of the invention are described in U.S. Pat. No. 3,011,982 issued Dec. 5, 1961 to Eugene A. Maduk et al. for "Refractory and Method of Making the Same" and in U.S. Pat. No. 3,011,983 issued Dec. 5, 1961 to Richard W. Ricker et al. for "Refractory and Method of Making the Same".

Another material which can be suitable is pyrolytic graphite, depending apparently on the orientation of its anisotropic crystals.

Further illustrative of the methods of the present invention are the following examples:

EXAMPLE I

A cell as illustrated in FIGS. 1 and 2 was operated at 40 amperes, 6.5 amperes per square inch anode current density, ½ inch anode-cathode distance x, 890°–900° C. temperature, and a bath composition of 0.8 BR-5% $LiF—Al_2O_3$, where BR is the weight ratio $NaF/AlF_3$. Sixteen $TiB_2$ cathode studs (½ inch diameter by 1½ inch length) obtained from PPG Industries and arrayed in 4 rows of 4 were attached to the cell bottom by dimensioning of the seats in the cell bottom such that an interference fit of 0.001 inch on the diameter would exist at operating temperature. The studs were seated to a depth of ½ inch, so that they protruded from the floor of the crucible a distance of one inch. The studs were confined to an area defined by the projected dimensions of the 2½ inch×2½ inch anode. The cathodic graphite crucible of 6⅛ inch outer diameter, 5-1/16 inch inner diameter, was equipped with an alumina refractory insulator liner of 5 inch outer diameter, 4-9/16 inch inner diameter, to prevent lateral current flow. The reduction cell was installed in a sealed Inconel furnace (not shown). An inert nitrogen atmosphere was maintained in the furnace throughout the 102 hour operating cycle.

During operation, the $TiB_2$ studs protruded no less than ½ inch above the metal pad. Periodic metal removal adjusted the metal pad depth to maintain the prescribed stud exposure height.

While maintaining the normal current flow, an attempt was made to measure the aluminum puddle height by lowering the anode until a "dead-short" condition developed. By noting the distance traveled from this point to a rest position on the $TiB_2$ cathode bars, an aluminum puddle height of ¼ inch was found. Initially, this measured puddle height was thought to be the equilibrium height at an anode-cathode distance x of ½ inch. A subtraction of the puddle height from x provides a value of ¼ inch for the actual thickness of bath at the zone of electrolysis. However, analysis of voltage measurements discussed in a subsequent paragraph suggests that the physical state of the system between electrodes differs somewhat from the image that emerges here.

The alumina content of the electrolyte was maintained by periodic additions of kiln activated hydrate (calcined alumina of total water content of e.g. 12.5%) at a rate based on an assumed current efficiency (CE) of 50%. Small scale cells are known to operate at low CE and the intention was to avoid mucking. Operations at a CE greater than the assumed value causes alumina impoverishment of the electrolyte that can be satisfied by a dissolution of the alumina refractory liner.

The remainder of the electrolyte composition was likewise maintained constant by periodic additions of components lost for instance by vaporization or by absorption into the cell walls.

Table 1 provides a listing of typical determined values for operation of the cell of this example.

TABLE 1

OPERATING PARAMETERS

| Parameter | Value | Footnotes |
|---|---|---|
| $E_{(cell)}$ | 3.32 | |
| VEXT | 1.70 | a |
| VINT | 1.2 | b |
| $E_P$ | 0.50 | c |
| $E_{(external)}$ | 1.0 | d |
| $E_B$ | 0.62 | e |

a VEXT was determined by extrapolating volt-ampere curves to 0 current. VEXT values include voltage contributions from $E_D$ and $E_P$ where subscripts D and P refer to decomposition and polarization, respectively.

b VINT refers to the constant voltage that appeared on sensing devices after current interruption of the cell. Dissipation of gas film and electron double layer overvoltages leaves only the alumina decomposition potential ($E_D$). As a matter of fact, the calculated $E_D$ based on free energies of formation for products and reactant of the $Al_2O_3$-carbon reaction at 900° C. and assuming an electrolyte that is saturated with ore is 1.204 volts.

c $E_P$, the polarization overvoltage is obtained by subtracting VINT from VEXT.

d $E_{(external)}$ is the metered voltage observed when anode and cathode $TiB_2$ studs are in contact at 40 amperes.

e $E_B$ is the voltage drop across the bath at ½ inch anode-cathode distance and 40 amperes. The quantity was evaluated from the following equation: $E_B=E_{(cell)}-E_D-E_P-E_{(external)}=0.62$ During the 2½ day interval that the crucible's refractory liner was operative, the cell functioned smoothly and metal-tap current efficiencies were consistently around 65%; quite good for small cells. However, liner dissolution eventually exposed the cathodic graphite crucible walls to electrolysis. Fine grained carbon quickly permeated the bath and reduced current efficiencies steadily. Nevertheless, the cell as operated for the remainder of the week to ascertain $TiB_2$ durability.

When the week was over, the $TiB_2$ studs were separated from the crucible bottom and treated in hot 30% $AlCl_3$ solution. The treatment successfully cleaned the studs of bath and metal. While some pieces were altered no more than one mil in cross section, most showed no change whatever.

Crucial to the operation of industrial cells at very close anode-cathode distance is the ability to maintain an adequate quantity of oxygen-containing species in the heart of the electrode interspace. A system of cathode studs for instance as in this example is uniquely capable of providing all the benefits of low anode-cathode distance and an abundant concentration of bath reactants anywhere on the anode surface by simply controlling metal depth to assure the presence of pools of fresh solvent.

A cathode system consisting of an unbroken continuous surface located very close to the anode is, in contrast, hampered by the space requirements of egressing anode gas and metal phases and ingressing bath, i.e. solvent, phase.

EXAMPLE II

A cell as pictured in FIGS. 3 and 4 was operated for 100 hours. The cathode was made of Union Carbide HDL material of composition 70% $TiB_2$ and 30% BN. The cathode as shown was made in two parts. The upper part, the grate 23, was a plate of the material machined to have five holes as shown in FIG. 4. The illustrated array of the four holes 26 gives the plate the character of a grate, while the central hole was for the purpose of receiving the supporting post 24. The supporting post was likewise machined, to provide the collar 37 to support the grate at the upper end of the post. The grate was of dimension 2 inches square, with the four holes each having a $\frac{3}{4}$ inch inner diameter. The hole for the post was $\frac{1}{2}$ inch inner diameter. The four bigger holes were provided with a slight chamfer (not shown) on the top edge for the purpose of assuring that no raised edges were present that might hinder runoff of the produced molten metal. The grate thickness was $\frac{3}{8}$ of an inch. The post was seated in a $\frac{1}{2}$ inch deep hole in the bottom of the graphite crucible, the hole in the crucible being dimensioned on the basis of the coefficient of thermal expansion of the graphite as compared to that of the post so that, at cell operating temperature, a snug fit resulted, for the purpose of supporting the post and grate well and to assure good flow of electricity from the graphite crucible into the post. The bath composition at the start of operation was 80.7% cryolite, 12.4% excess (i.e. in addition to that in the cryolite) $AlF_3$, 5% $CaF_2$ and 1.9% $Al_2O_3$. A metal pad was supplied to begin with, so that there would be a pad in existence at start-up. The anode-cathode distance x was chosen to be $\frac{1}{2}$ inch, with cell current at 30 amperes, with the distance from the crucible bottom to the underside of the grate being 1.15 inches. The cell temperature aimed at was 960° C., with the extra heat, over that supplied by the resistance heating caused by the 30 amperes current flow, being supplied by the furnace (not shown) described in Example I. Over the 100 hour period, the average temperature was essentially 960° C., with the average voltage across the cell being 2.53 volts. Average VINT was 1.44 volts, with average VEXT lying at 1.57 volts. The average current efficiency measured on the basis of the gas evolved (Pearson-Waddington equation—see Example VI) was 70%, while the current efficiency measured on the basis of the metal produced was 67%. The total metal produced, minus the original pad, was 658 grams, this being produced from 932 grams of fed $Al_2O_3$, the remainder of the $Al_2O_3$ necessary for the 658 grams of metal having come from dissolution of liner 17. The total bath used was 13.5 pounds. The grate did not become sludge covered at any time during the test, and the $\frac{3}{4}$ inch holes did not become clogged. Circulation of bath appeared good during the entire run, and all metal taps were very clean. During operation, the metal pad depth was controlled to between $\frac{1}{2}$ and $\frac{3}{4}$-inch.

EXAMPLE III

In this test, the two tubes 28 shown in FIG. 5 were cold pressed and sintered $TiB_2$. 99.4% of theoretical density, obtained from PPG Industries, one designated Lot No. 2903-1, the other designated Lot No. 2903-2. The tubes were both 6 inches long and approximately 1-11/16 inches outer diameter. The wall thickness was approximately $\frac{1}{8}$ of an inch. The tubes were embedded to a depth of $\frac{1}{2}$ inch in the graphite crucible, in holes in the crucible, appropriately dimensioned to provide a snug fit at operating temperature. The anode-cathode distance was $\frac{1}{2}$ inch, with cell current at 40 amperes and target cell operating temperature at 960° C. The bath composition was the same as in Example II. At start-up, the interior of the tubes had been filled with aluminum, so that a column of molten aluminum was contained already within the tubes at start-up of electrolysis. Additionally, the pad of molten aluminum was also present at start-up. The anode above the two pipes had an oval cross section, the dimension horizontally in FIG. 5 being 4 inches, with the depth into FIG. 5 being $1\frac{7}{8}$ inches, to given an anode area of 5.9 square inches. Typical operating conditions were that the temperature was 950° C., with the volts across the cell equalling 2.67 volts, with a VINT of 1.38 volts, a VEXT of 1.66 volts and a gascalculated current efficiency of 73%. One of the tubes was accidentally broken about halfway through the test. The unbroken tube, Lot No. 2903-1, was found at the end of the test to still be clean inside, with no sludge deposits. The metal pad depth was held between $3\frac{1}{2}$ and 4 inches during one segment of the operation, but it was found that the cell ran more smoothly when the pad depth was held between 2 and 3 inches.

EXAMPLE IV

This test utilized the arrangement shown in FIGS. 7 and 8. A single tube of cold pressed and sintered $TiB_2$, obtained from Kawecki Berylco Industries under the designation HC 369-2, was used as the cathode in this test. The characteristics of the tube were as follows:

| | |
|---|---|
| Outer Diameter | 2.58 inches |
| Inner Diameter | 1.88 inches |
| Wall Thickness | 0.35 inches |
| Length | 1.90 inches |
| Weight | 325 grams |
| Percent of Theoretical Density | 93.7% |

The tube was embedded $\frac{1}{2}$ inch deep in the graphite crucible in the usual manner described in Examples II and III. The bath composition was also as in Examples II and III. An aluminum pad was provided at the time of start-up, and the center of the tube had been filled with aluminum. Operating conditions aimed at were a cell temperature of 960° C., a cell current of 40 amperes, and an anode-cathode distance x of $\frac{1}{2}$ inch. The solid anode had a circular cross section of $2\frac{3}{4}$ inches diameter. This test was run for 100 hours. The average temperature over the run was 971° C., with an average cell voltage of 3.12 volts, an average VINT of 1.51 volts, and an average VEXT of 1.86 volts. The gas-calculated current efficiency measured 74%, with the metal-calculated current efficiency being 55%. The depth of the metal pad was held between $\frac{1}{2}$ and $\frac{3}{4}$-inch.

EXAMPLE V

A cell was run as in Example II for 100 hours for the purpose of evaluating three pyrolytic graphite cups received from Union Carbide Corporation. The cups were $2\frac{1}{2}$ inches high, had a top outer diameter of $1\frac{1}{4}$ inches, a bottom outer diameter of 1 inch, and a wall thickness of 1/16 inch. They weighed 9.5, 10.9 and 14.5 grams, respectively. They were secured in the bottom of the cell, at the corners of an equilateral triangle. Before start-up, granular aluminum was filled into each cup. The granularity is advantageous, because expansion of the aluminum during heat up and before melting does not split the cup. An alternative is to use a piece of aluminum machined to a shape which allows for expansion without contacting the side walls of the cups until the shape becomes molten. The 100 hours of operation were completed, and, while the cups did not appear to be as resistant to attack by molten aluminum and bath as $TiB_2$ composite material can be, the test was certainly not a failure, so that pyrolytic graphite material is one alternative to the refractory hard metals. There appeared to be some formation of aluminum carbide, but the cups had substantially retained their identity at the end of the test except for some accidental breakage. It is noted that pyrolytic graphite cups survive while pyrolytic graphite studs have been found not to survive the 100 hour test. It is thought that the graphite crystals are more preferably oriented in cups in respect to resisting disintegration in the cell than they are in studs. It was found at the end of the test that the cups were each filled with aluminum metal, so that, since they were upright in the cell, they each presented cathodic surface areas in effect composed, at the closest anode-cathode spacing, of an outer ring of graphite and a circular expanse of molten aluminum within the ring.

EXAMPLE VI

A 4,000 ampere cell was run. As viewed from above, with lid and molten contents removed, it was constructed as shown in FIG. 9. The inner space in the plane of FIG. 9 measured 22 inches by 66 inches. The refractory surrounding the area to contain the molten materials was of suitable thickness and had, as lining material for the vertical walls, brick made of $Al_2O_3$. The floor of the cell was made of graphite blocks, which were provided with recesses for receiving the shown refractory hard metal plates. The set of plates 38 at the left of FIG. 9 was used in combination with a monolithic carbon anode (not shown) of the conventional prebaked type essentially for the purpose of keeping the cell at the desired temperature. These plates 38 at the left measured 4 inches×4 inches×9/16 inches and were essentially $TiB_2$. They were embedded in the graphite bottom blocks at a depth of 3 inches, so that 1 inch of them protruded up into the metal pad during cell operation. The cathode at the right of FIG. 9 was chosen to be the one run at reduced anode-cathode spacing. The 18 plates 35 pictured were supplied by the Union Carbide Corporation. They measured 4 inches×6 inches×¾ inches and were embedded 1½ inches into the graphite bottom, so that they protruded up into the cell cavity 4½ inches. Each plate weighed about 1 kilogram. The plates are designated material type HDL by Union Carbide. This composite ceramic material consists of 70% $TiB_2$-30% BN hot pressed into a standard 14½ inch diameter×14½ inch length billet. Geometric shapes such as plates and studs are produced from the billet. HDL has low electrical resistivity (50–150 microohm-centimeters or 20–60 microohm-inches) and is wet by molten aluminum. In addition, it is readily machined and accepts drill and tap easily. It is notch sensitive like glass. Flexural strength as a function of temperature are: 10,000 pounds per square inch (10 ksi) at room temperature, 12 ksi at 1000° C., and 15 ksi at 1600° C. The material has a thermal expansion coefficient of $8.05\times10^{-6}$/°C. and a hot pressed density of 89% of theoretical.

A second anode (not shown) was used in combination with the plates 35. It too was of the conventional, monolithic, prebaked type.

Sufficient aluminum metal was laid on the floor of the cell during heat up so that a molten aluminum pad would form during the heat up process to protect the graphite and to provide for the presence of a molten aluminum pad from the very first instant of electrolysis. The electrolyte was melted in a separate furnace and then poured in the molten state into the cell. The ratio $NaF/AlF_3$ in the electrolyte was 0.8, with a presence of 5% LiF, remainder NaF, $AlF_3$ and $Al_2O_3$. Here, the LiF, NaF, and $AlF_3$ represent the solvent, while the $Al_2O_3$ is the compound to be electrolyzed. During operation, the approximate amount of alumina required was fed into the center of the cell using techniques for instance as shown in U.S. Pat. No. 3,681,229 issued Aug. 1, 1972 to R. L. Lowe for "Alumina Feeder". Operation was with the bath saturated with alumina, due to the fact that the cell lining was alumina. The cell had a lid equipped with appropriate passageways for the two anodes arranged respectively above the two cathode locations. The cross sections of the anodes matched approximately the outer perimeters of the cathode plate arrays shown in FIG. 9. The lid also had an entry centrally located for the charging of the alumina feed and some closeable observation ports. A water-containing atmosphere was provided in the cell, using nitrogen bubbled through water, to protect against anode dusting, according to the teachings of U.S. Pat. No. 3,855,086 issued Dec. 17, 1974 to Sleppy et al. for "Carbon Anode Protection in Aluminum Smelting Cells". Tapping of the produced aluminum metal was controlled so that the aluminum metal pad always covered the $TiB_2$ plates of the left cathode in FIG. 9 and so that the plates of the right cathode in FIG. 9 were always protruding up out of the aluminum metal pad. In general, tapping was carried out when the metal depth had reached 2½ inches, at which time the metal depth would be decreased to 1¼ inches.

During the first week of operation, the following average data were obtained:

(a) $E_{(cell)}=3.5\pm0.1$ volts (v) at ½ inch anode-cathode distance (ACD) at the cathode on the right and 6.5 amperes per square inch (a/in$^2$) anode current density. During this measurement and those in the data which follows, the anode and cathode at the left were disconnected from their power supply.

(b) $E_{(bottom)}=0.061\pm0.002$ v $E_{(bottom)}$ here and in the data which follows is the voltage drop measured between a probe, immersed in the metal pad, and the junction of the collector bar of the right cathode with the cathode bus, when the heater anode-cathode unit was disconnected. The collector bar below the cathode of the ½ inch ACD unit was of mild steel, 3 inches diameter. It was provided in a bore in the graphite, the bore being machined to provide 0.001 inch interference fit on the diameter at operating temperature. The bore surface was about 5 inches from the closest lower surface of the HDL plates. The distance from the edge of graphite block, along the collector bar, to the bus was 20 inches.

(c) Current efficiency (CE) by gas analysis (Pearson-Waddington equation—see the article by G. T. Pearson and J. Waddington, Discussions of the Faraday Society, Volume 1, (1947), (starting at page 307) was 90–91%. This was measured, here and in the data following, with both the anode-cathode units connected to their power supplies.

(d) Cell temperature=902°±5°.

Average data over a period measuring 23 days from start-up, at 6.5 a/in$^2$, ½ inch ACD at cathode on the right, were:

$CE_{(gas)}=89.2\%$, $E_{(bottom)}=0.065$v, $E_{(cell)}=3.77$ v, kilowatt-hours per pound of aluminum produced $(KWH/lb.)_{gas}=5.72$ (determined here and in the data that follows by using gas current efficiency and the equation $KWH/lb.=E_{(cell)}\div(0.7395\cdot CE)$), cell temperature the first eight days 900° C., remainder 930° C.

Average data for operation at 8.0 a/in$^2$, ½ inch ACD, 10 days, were:

$CE_{(gas)}=88.1$ $E_{(bottom)}=0.069v$, $E_{(cell)}=4.27v$, $(KWH/lb.)_{gas}=6.55$, cell temperature (T)=930° C.

This operation realized a 24% increase in production for a 15% increase in KWH/lb. at an apparent slight reduction in current efficiency by increasing current density from 6.5 to 8.0 a/in$^2$. The higher current density was found necessary to restore equilibrium heat loss in a representative industrial cell hypothetically operating at ½ inch ACD. Importantly, current efficiencies do not seem to be affected adversely.

Operations at 8 a/in$^2$, anode-cathode distance ½ inch, were conducted for another 10 days. Average $CE_{(gas)}$ in this interval plus the preceding 10 day interval was 89.7±2.2%, $E_{(cell)}=4.2v$, $E_{(bottom)}=0.07v$, VEXT=1-.6-1.75v, VINT=1.2-1.4v, T=930° C.

Anode current density was increased to 10 a/in$^2$ with ACD remaining at ½ inch for 7 days. $CE_{(gas)}=86.4\pm2.8\%$, $E_{(cell)}=4.3-4.5v$, $E_{(bottom)}=0.09v$, VEXT=1.5-1.6v, VINT=1.2-1.3v.

The increase in anode current density (CD) from 6.5 to 8.0 a/in$^2$ did not affect $CE_{(gas)}$ while providing 23% more production.

The increase in CD from 8 to 10 a/in$^2$ reduced CE 3.7% according to gas analysis while increasing production another 25%. The increase in production over standard industrial CD (6.5 a/in$^2$) in going to 10 a/in$^2$ is 53.9% while apparently giving up 3.7% production through CE loss.

The ACD was opened to 1¼ inch at 10 a/in$^2$ for two days with no effect on $CE_{(gas)}$. The CD was reduced to 6.5 a/in$^2$ at 1¼ inch ACD for two days without significantly altering $CE_{(gas)}$.

The cell was shut down after 65 days of continuous operations. Autopsy showed that the 18 $TiB_2$-30% BN 8 inch× 6 inch×¾ inch cathode plates survived admirably. The plates were in good condition with no apparent loss in dimension from wear, reaction, or erosion.

EXAMPLE VII

Ninety parts by weight of titanium diboride ($TiB_2$) powder (bought from Kawecki-Berylco Industries under the designation Chemical Grade Titanium Diboride) and 10 parts of boron nitride (BN) powder (bought from Union Carbide Corporation under the designation Boron Nitride Powder—HCP Grade) were blended in a double-cone blender for 30 minutes. The particle size distribution of the titanium diboride powder was as shown in Table 2.

Table 2.

Particle Size Distribution of $TiB_2$ Powder

| Particle Diameter, in Microns | Weight-% of Material Below the Diameter |
|---|---|
| 44 | 100 |
| 30 | 99 |
| 20 | 95 |
| 15 | 91 |
| 10 | 84 |
| 8 | 76 |
| 6 | 64 |
| 5 | 50 |
| 4 | 34 |
| 3 | 20 |
| 2 | 10 |
| 1 | 5 |

It will be seen that the median particle size was 5 microns. The $TiB_2$ powder had the chemical analysis givin in Table 3.

Table 3.

Chemical Analysis of $TiB_2$ Powder

| Substance | Weight-% |
|---|---|
| O | 0.28 |
| C | 0.14 |
| N | 0.008 |
| Fe | 0.2 |
| $TiB_2$ | Remainder |

X-ray defraction analysis showed that the titanium and boron were present completely as titanium diboride. The boron nitride powder was 94.5 weight-% minus 325 mesh material having a tap density of 0.2 grams per cubic centimeter. It was at least 99 weight-% B plus N, with up to 0.5% 0, up to 0.4% C, and up to 0.1% other metal impurities. The resulting blended powder was cold isostatically pressed to a pipe shape nominally 1.25 inches inner diameter by 2 inches outer diameter by 2.4 inches long at 60,000 pounds per square inch pressure, to approximately 70 percent of theoretical density. The pressing procedure was by the "wet bag" technique, using a rubber mold supplied by the Trexler Rubber Company, Ravenna, Ohio, the pressure being transmitted to the mold through a water medium. This pipe was sintered at 1975° C. for one hour in argon to improve the integrity and conductivity of the pipe. Sintering resulted in slight densification (shown as shrinkage in Table 4) with substantial improvement in pipe integrity.

Table 4.

Dimensions of $TiB_2$ - 10% BN Pipe Electrode

| Condition | ID (in.) | OD (in.) | Length (in.) | Weight (grams) |
|---|---|---|---|---|
| Green | 1.28 | 2.03 | 2.37 | 225.1 |
| Sintered | 1.25 | 2.01 | 2.30 | 221.6 |

This pipe was installed in a laboratory smelting cell in the manner shown in FIGS. 7 and 8. The bath composition used in the cell measured, in weight percent, 79% $Na_3AlF_6$, 12% $AlF_3$, 5% $CaF_2$, and 4% $Al_2O_3$, the bath ratio ($NaF/AlF_3$) being, on a weight basis, approximately 1.10. Operating temperatures were around 960° C., and anode current density was maintained at 6.5 amperes per square inch, i.e. 40 amperes electrical current flow through the cell.

The pipe survived 100 hours of operation, with analysis of the aluminum product revealing very little titanium present, probably no more than is expected from the contribution from the $Al_2O_3$ feed.

Compositions are given herein in percent by weight, unless indicated otherwise.

It will be understood that the above description of the present invention is susceptible to various modifications, changes and adaptations and the same are intended to be comprehended within the meaning and range of equivalents of the appended claims.

What is claimed is:

1. A method for the electrolytic production of metal, including electrolyzing, between anodic and cathodic surface areas, a compound of the metal dissolved in a molten solvent, the electrolyzing being performed at a temperature such that the metal is formed in the molten state, wherein the improvement comprises the provision of cathodic surface area in the form of a grate inserted in the solvent, with the anode-cathode distance being up to $1\frac{1}{4}$ inches.

2. A method as claimed in claim 1, wherein the grate is supported centrally on a post.

3. A method as claimed in claim 1, wherein the metal collects in a molten metal pad, said post extending into the molten metal pad.

4. A method as claimed in claim 1, wherein the grate has a face turned toward the anodic surface area.

5. A method as claimed in claim 1, wherein the metal is aluminum.

6. A method as claimed in claim 5, wherein the compound is alumina.

7. A method as claimed in claim 6, wherein the holes of the grate are circular and of a diameter greater than $\frac{1}{2}$ inch.

8. A method as claimed in claim 1, wherein the metal collects in a molten metal pad, the distance separating the metal pad from the anodic surface area being at least $1\frac{1}{2}$ inches plus the thickness of the grate.

9. A method as claimed in claim 8, the distance separating the metal pad from the anodic surface area being at least 2 inches plus the thickness of the grate.

10. A method as claimed in claim 8, the distance separating the metal pad from the anodic surface area being at least $2\frac{1}{2}$ plus the thickness of the grate.

* * * * *

UNITED STATES PATENT AND TRADEMARK OFFICE

CERTIFICATE OF CORRECTION

PATENT NO. : 4,219,391

DATED : August 26, 1980

INVENTOR(S) : Perry A. Foster Jr.

It is certified that error appears in the above-identified patent and that said Letters Patent are hereby corrected as shown below:

| | |
|---|---|
| Col. 3, line 29 | Change "by" to --be--. |
| Col. 8, line 37 | After "cell", change "as" to --was-- |
| Col. 13, lines 17-18 | Change "VEXT = 1-.6-1.75v" to --VEXT = 1.6-1.75v--. |
| Col. 15, line 6<br>Claim 3, line 1 | Change "1" to --2--. |
| Col. 16, line 13<br>Claim 10, line 3 | After "2-1/2", insert --inches--. |

Signed and Sealed this

Ninth Day of August 1983

[SEAL]

Attest:

GERALD J. MOSSINGHOFF

Attesting Officer

Commissioner of Patents and Trademarks